US007440720B2

(12) United States Patent
Takehara

(10) Patent No.: US 7,440,720 B2
(45) Date of Patent: Oct. 21, 2008

(54) IMAGE FORMING APPARATUS AND IMAGE TRANSFERRING UNIT FOR THE SAME

(75) Inventor: Atsushi Takehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1172 days.

(21) Appl. No.: 10/666,256

(22) Filed: Sep. 22, 2003

(65) Prior Publication Data

US 2006/0170936 A1 Aug. 3, 2006

(30) Foreign Application Priority Data

Sep. 20, 2002 (JP) ..... 2002-275664
Aug. 20, 2003 (JP) ..... 2003-296274

(51) Int. Cl.
*G03G 15/01* (2006.01)
*G03G 15/20* (2006.01)

(52) U.S. Cl. ..... 399/299; 399/313

(58) Field of Classification Search ..... 399/299, 399/302, 303, 313, 318
See application file for complete search history.

(56) References Cited

U.S. PATENT DOCUMENTS 4,796,047 A 1/1989 Fowlkes et al.
5,469,248 A * 11/1995 Fujiwara et al. ..... 399/313 X
6,044,244 A * 3/2000 Watanabe et al. ..... 399/313
6,173,148 B1 * 1/2001 Matsuda et al. ..... 399/313 X
6,249,304 B1 6/2001 Sawayama et al.
6,292,206 B1 9/2001 Takehara et al.
6,295,438 B1 9/2001 Fujishiro et al.
6,334,039 B1 12/2001 Yoshinaga et al.
6,366,754 B1 4/2002 Sato et al.
2001/0055499 A1 * 12/2001 Sato ..... 399/299 X
2002/0018673 A1 2/2002 Mizoguchi et al.

FOREIGN PATENT DOCUMENTS

EP 0 491 087 6/1992
EP 0 899 625 3/1999

(Continued)

OTHER PUBLICATIONS

U.S. Appl. No. 10/263,802, filed Oct. 4, 2002, Ishibashi et al.

(Continued)

*Primary Examiner*—Sandra L Brase
(74) *Attorney, Agent, or Firm*—Oblon, Spivak, McClelland, Maier & Neustadt, P.C.

(57) ABSTRACT

An image forming apparatus of the present invention includes a plurality of image carriers arranged side by side and a charging device, exposing device and developing device arranged around each image carrier. An image transferring unit includes an image transfer belt and a plurality of bias applying members for applying image transfer biases to image transfer nips formed between the bias applying members and the image carriers, which face each other with the intermediary of the image transfer belt. Each image transferring member has an axis positioned downstream, in the direction of movement of the image transfer belt, of a virtual vertical line extending from the axis of the associated image carrier downward. At least two of the bias applying members are provided with respective belt holding members at the downstream side in the direction of movement of the image transfer belt.

17 Claims, 9 Drawing Sheets

FOREIGN PATENT DOCUMENTS

| | | |
|---|---|---|
| EP | 1 237 056 | 9/2002 |
| JP | 6-95536 | 4/1994 |
| JP | 8-254907 | 10/1996 |
| JP | 8-314289 | 11/1996 |
| JP | 9-22204 | 1/1997 |
| JP | 2002-139927 | 5/2002 |

OTHER PUBLICATIONS

U.S. Appl. No. 10/375,115, filed Feb. 28, 2003, Yamanaka et al.
U.S. Appl. No. 10/861,440, filed Jun. 7, 2004, Sawai et al.
U.S. Appl. No. 10/868,912, filed Jun. 17, 2004, Kato et al.
U.S. Appl. No. 11/276,666, filed Mar. 9, 2006, Takehara et al.
U.S. Appl. No. 11/276,377, filed Feb. 27, 2006, Iwakura et al.

* cited by examiner

IMAGE FORMING APPARATUS AND IMAGE TRANSFERRING UNIT FOR THE SAME

BACKGROUND OF THE INVENTION

1. Field of the Invention

The present invention relates to a copier, facsimile apparatus, plotter or similar color image forming apparatus and more particularly to an image transferring unit for an image forming apparatus.

2. Description of the Background Art

A color image forming apparatus of the type including four image forming units arranged in a tandem configuration is conventional. In this type of apparatus, bias applying members each face a particular photoconductive drum or similar image carrier with the intermediary of an image transfer belt. Biases are applied to the bias applying members for sequentially transferring toner images formed on the drums to a sheet one above the other.

As for a black-and-white image forming apparatus, various technologies relating to the position of a bias applying means relative to a photoconductive drum have heretofore been proposed. For example, when a drum and a bias applying member are located to face each other with the intermediary of an image transfer belt, part of the image transfer belt upstream of an image transfer nip may be raised to wrap around the drum. This configuration allows a sheet to contact the drum before subject to an electric field for image transfer for thereby reducing toner scattering and defective images ascribable to discharge.

Japanese Patent No. 3,131,126, for example, proposes to wrap part of an image transfer belt downstream of an image transfer nip around a photoconductive drum for the purpose of reducing the amount of discharge in the event of separation discharge and reducing, e.g., reverse image transfer. Japanese Patent Laid-Open Publication No. 6-202497 contemplates to reduce defective images without raising part of an image transfer belt upstream or downstream of an image transfer nip. More specifically, this document teaches a configuration that reduces the nip width between a bias applying member and an image transfer belt for thereby positioning the regions around the inlet and outlet of an image transfer nip and where an electric field acts remote from a bias applying member.

On the other hand, in a tandem, four-color image forming apparatus, accurate register of images of four different colors is a target difficult to tackle. In this respect, when part of the image transfer belt upstream of the image transfer belt is raised, as taught in Japanese Patent mentioned earlier, the leading edge of a sheet is apt to abut again the drum on entering the image transfer nip, resulting in a fine change in speed of the order of several ten micrometers and therefore in color shift. This is particularly true when the sheet is relatively thick.

As for image transfer in a tandem, four-color image forming apparatus, Japanese Patent Laid-Open Publication 6-95536, for example, proposes to shift an image transfer roller from a position where it faces a photoconductive drum via an image transfer belt to the downstream side in the direction of sheet conveyance. According to the above document, this configuration obviates, e.g., a change in the speed of the drum when a sheet enters an image transfer nip due to pressure acting on the image transfer roller.

The scheme taught in Laid-Open Publication No. 6-202497 is successful to reduce an impact to act on the drum ascribable to the leading edge of a sheet. However, it is difficult to maintain the bias applying member and image transfer belt in uniform contact because the contact width thereof is reduced. Consequently, image transfer tends to be defective due to short parallelism between the drum and the bias applying member or the bend of the bias applying member. Further, by simply reducing the contact width of the bias applying member and image transfer belt, it is impossible to wrap part of the belt upstream of the image transfer nip around the drum over a desired width and therefore to sufficiently obviate abnormal discharge at the position upstream of the image transfer nip.

The configuration disclosed in Laid-Open Publication No. 6-95536 has a problem that a current for image transfer cannot flow unless the charge roller is raised by pressure high enough to overcome the tension of the image transfer belt. Such high pressure translates into high nip pressure between the image transfer roller and the drum. As a result, it is likely that an image is locally lost as if vermiculated or that a toner image formed on a sheet at a preceding station is peeled off. Moreover, the leading edge of a sheet exerts a load on entering the image transfer nip due to the high nip pressure, bringing about fine color shift.

SUMMARY OF THE INVENTION

It is an object of the present invention to provide a tandem, four-color image forming apparatus capable of accurately controlling color shift to thereby produce high-quality images and an image transferring unit for the same.

An image forming apparatus for forming a toner image on a sheet-like recording medium of the present invention includes a plurality of image carriers arranged side by side. A charger, an exposing device and a developing device are arranged around each image carrier for charging the image carrier, forming a latent image on the image carrier and developing the latent image with toner to thereby produce a corresponding toner image. An image transferring unit sequentially transferring toner images so formed on the image carriers to the recording medium one above the other. The image transferring unit includes an image transfer belt and a plurality of bias applying members for applying image transfer biases to image transfer nips formed between them and the image carriers, which face each other with the intermediary of the image transfer belt. The image transferring members each has an axis positioned downstream, in the direction of movement of the image transfer belt, of a virtual vertical line extending from the axis of the associated image carrier downward. At least two bias applying members are provided with respective belt holding members positioned downstream of the bias applying members in the direction of movement of the image transfer belt.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENTS

Figure 1:
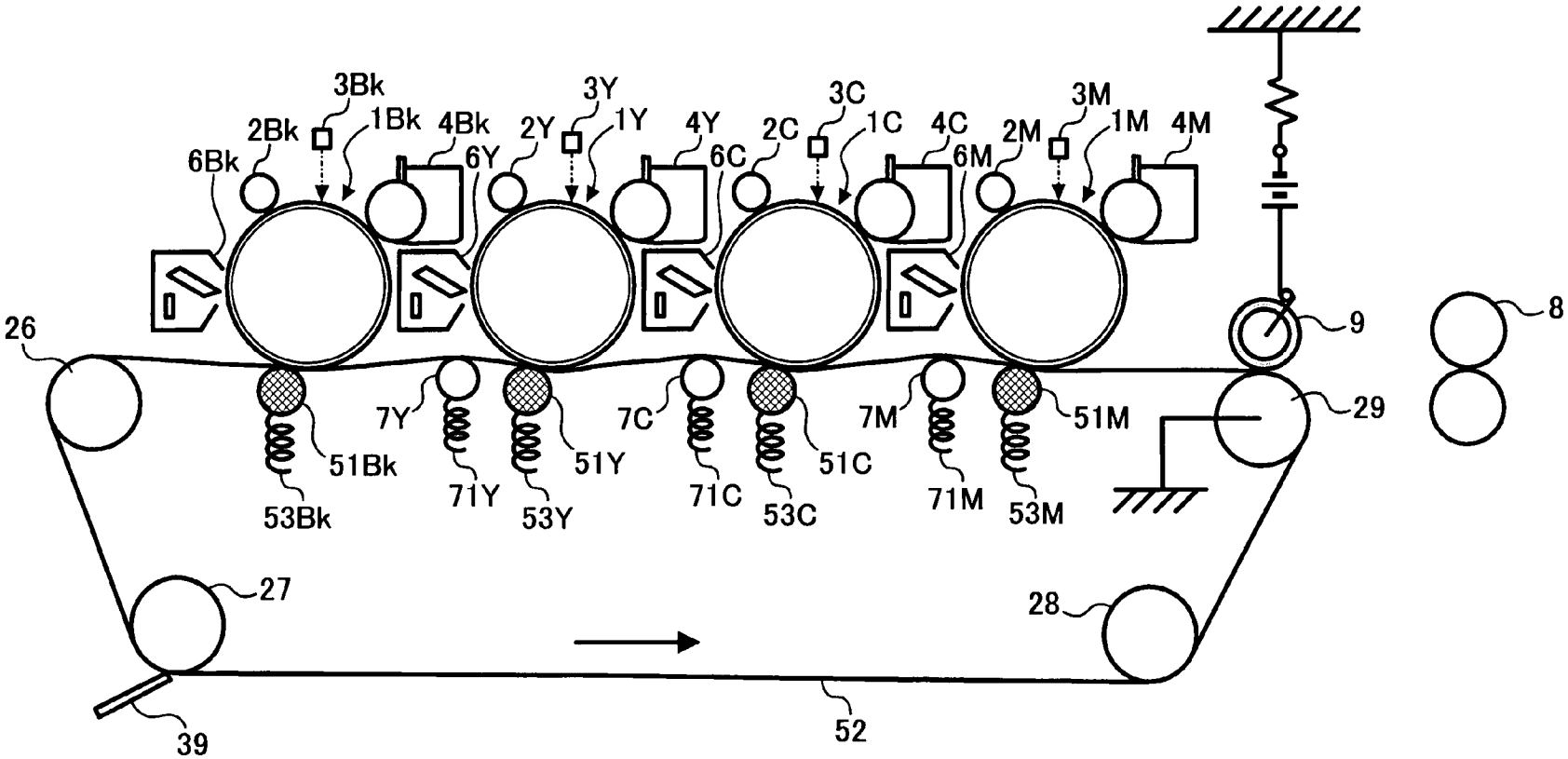
FIG. 1 is a fragmentary front view showing a first embodiment of the tandem, four-color image forming apparatus in accordance with the present invention.

Referring to FIGS. 1 through 9, a first embodiment of the image forming apparatus in accordance with the present invention is shown and implemented as a tandem, four-color direct image transfer type of color printer by of example. As shown, the color printer includes two sheet cassettes or sheet feed trays 21 and 22, which are loaded with a stack of sheets P each, and a manual sheet feed tray 20. A pickup roller 24, associated with designated one of the sheet cassettes 21 and 22, sequentially pays out the sheets P one by one, the top sheet P first. The sheet P thus paid out is conveyed to a registration roller pair 8 via a roller pair 25. Likewise, sheets, not shown, stacked on the manual feed tray are sequentially paid out by a pickup roller 23 toward the registration roller pair 8.

The registration roller 8 nips the leading edge of the sheet P to thereby correct skew. Subsequently, the registration roller 8 starts, when a registration clutch, not shown, is coupled, conveying the sheet P at such timing that the leading edge of the sheet P meets the leading edge of a toner image formed on a photoconductive drum 1M (magenta), which will be described specifically later. When the sheet P passes a nip between an image transfer belt (simply belt hereinafter) 52 and an adhesion roller 9, see FIG. 1, the sheet P is caused to electrostatically adhere to the belt 52 by a bias applied to the adhesion roller 9 and conveyed at preselected process linear velocity.

The drum 1M and other drums 1C (cyan), 1Y (yellow) and 1Bk (black) respectively face image transfer rollers 51M, 51C, 51Y and or bias applying members 51Bk with the intermediary of the belt 52. An image transfer bias, opposite in polarity to a charge deposited on toner, is applied to each of the image transfer rollers 51M through 51Bk. Therefore, when the sheet P is conveyed by the belt 52 via the consecutive drums 1M through 1Bk, a magenta, a cyan, a yellow and a black toner image are sequentially transferred from the drums 1M through 1Bk to the sheet P one above the other, completing a four-color or full-color toner image on the sheet P. The image transfer rollers 51M through 51Bk are formed of hydrine rubber.

Subsequently, the sheet, carrying the full-color toner image thereon, is separated from the belt 52 by curvature at a downstream where the belt 52 is passed over a drive roller 26 and then conveyed to a fixing unit 30. In the fixing unit 30, when the sheet P is conveyed via a nip between a fixing belt 31 and a press roller 32, the toner image is fixed on the sheet P by heat and pressure. In a simplex print mode, the sheet P, coming out of the fixing unit 30, is driven out face down to a print tray 33 formed on the top of the printer body.

On the other hand, in a duplex print mode, the sheet P, coming out of the fixing unit 30, is conveyed to a reversing unit, not shown, reversed thereby, and then conveyed to a duplex conveying unit 35 located below an image transferring unit 34. Subsequently, the sheet P is again fed by the duplex conveying unit 35 to the registration roller pair 8 via roller pairs 36 and 25. Thereafter, the sheet P is driven out to the print tray 33 via the fixing unit 30 in the same manner as in the simplex print mode.

Figure 4:
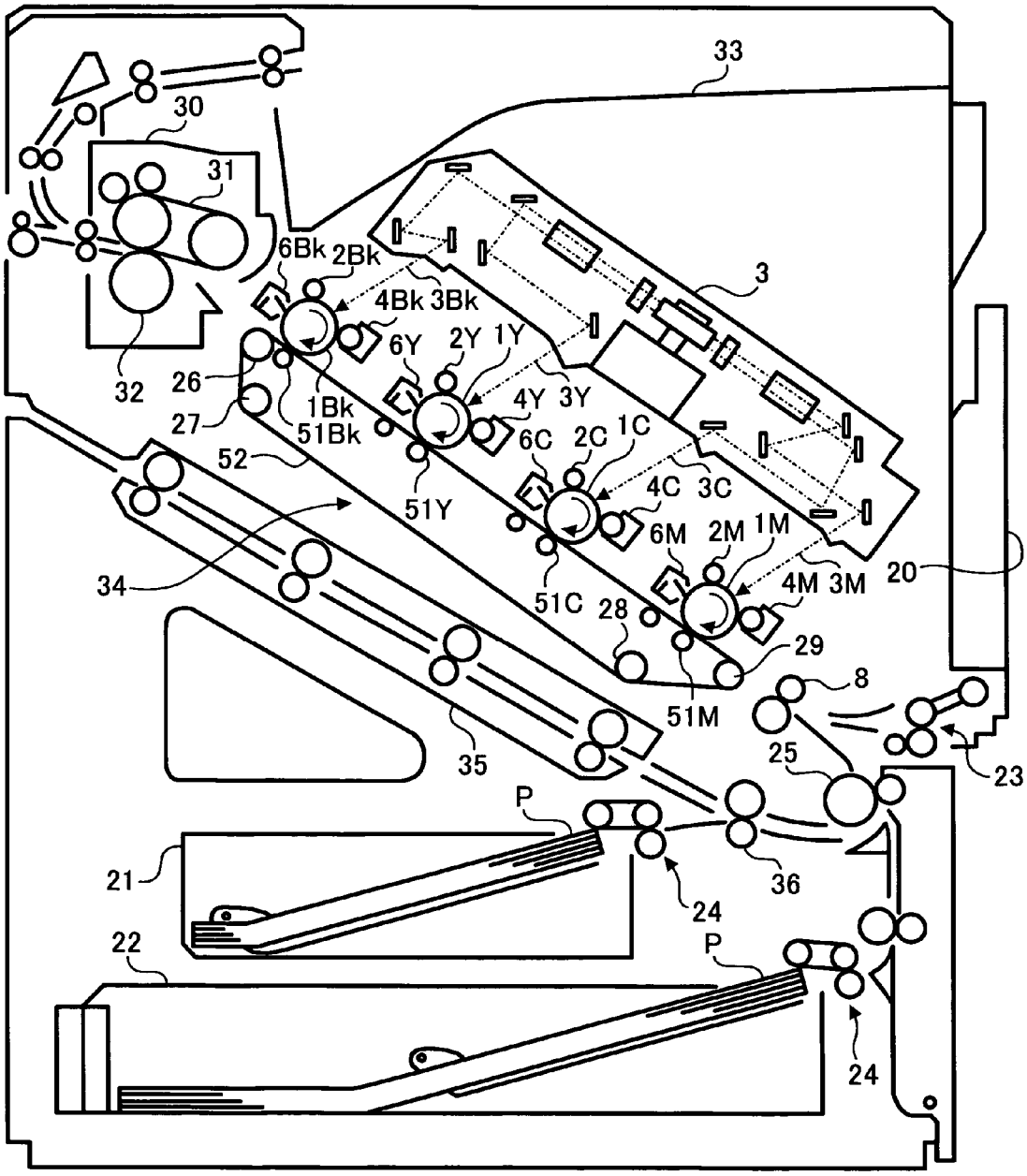
FIG. 4 is a front view showing the general construction of the first embodiment.

As shown in FIG. 1, charging means 2, exposing means 3, developing means 4 and cleaning means 6 are arranged around each of the four drums 1M through 1Bk. As shown in FIG. 4, the exposing means 3 all are constructed into a single exposing unit 3 configured to emit light beams 3M through 3Bk toward the drums 1M through 1Bk, respectively.

As shown in FIG. 1, the drums 1M through 1Bk contact the belt 52 while facing the image transfer rollers 51M through 51Bk, respectively. Springs or biasing means 53M, 53C, 53Y and 53Bk respectively bias the image transfer rollers 51M, 51C, 51Y and 51Bk toward the drums 1M, 1C, 1Y and 1Bk. The image transfer rollers 51M through 51Bk and springs 53C through 53Bk constitute image transferring means.

The belt 52 is formed of PVDF (polyvinylidene fluoride) and passed over support rollers 27, 28 and 29 as well as over the drive roller 26 mentioned earlier. The image transfer rollers 51M through 51Bk, serving as bias applying means, may be replaced with brushes, brush rollers or the like, if desired. The illustrative embodiment determines specific width over which each drum 1 and belt 5 contact as well as specific pressure and specific width over which each bias applying member 51 and belt 52 contact as well as specific pressure. In this sense, the image transfer rollers 51M through 51Bk are desirable.

Belt holding members or image transfer body holding members 7M, 7C and 7Y are respectively positioned downstream of the image transfer rollers 51M, 51C and 51Y in the direction of movement of the belt 51, constantly pressing the belt 52 against the drums 1M, 1C and 1Y. Pressing means 37M, 37C and 37Y, see FIG. 3, constantly bias the belt holding members 7M, 7C and 7Y, respectively.

The belt 52, support rollers 26 through 29, image transfer rollers 51M through 51Bk, springs 53M through 53Bk, belt holding members 7M through 7Y and pressing means 37M through 37Y constitute the image transferring unit 34 mentioned earlier. In FIG. 1, cleaning means 39 cleans the belt 52 after image transfer.

The operation of the color printer will be briefly described hereinafter. The charging means 2 assigned to each of the drums 1M through 1Bk uniformly charges the surface of the drum 1. The exposing means 3 exposes the charged surface of the drum 1 imagewise so as to form a latent image. Subsequently the developing means 4 develops the latent image to thereby produce a corresponding toner image.

A sheet P is fed from any one of the sheet cassettes 21 and 22 and manual feed tray 20 to the registration roller pair 8 and then conveyed by the registration roller pair 8, as stated earlier. Usually, the adhesion roller 9 charges the sheet P for thereby causing it to electrostatically adhere to the belt 51. In the illustrative embodiment the adhesion roller 9 is implemented as a sponge roller although it may be implemented as, e.g., a brush. While the belt 52 is conveying the sheet P via the consecutive drums 1Y through 1Bk, an M toner image through a black toner image are sequentially transferred from the drums 1Y through 1Bk to the belt 52, completing a full-color toner image on the belt 52.

Figure 2:
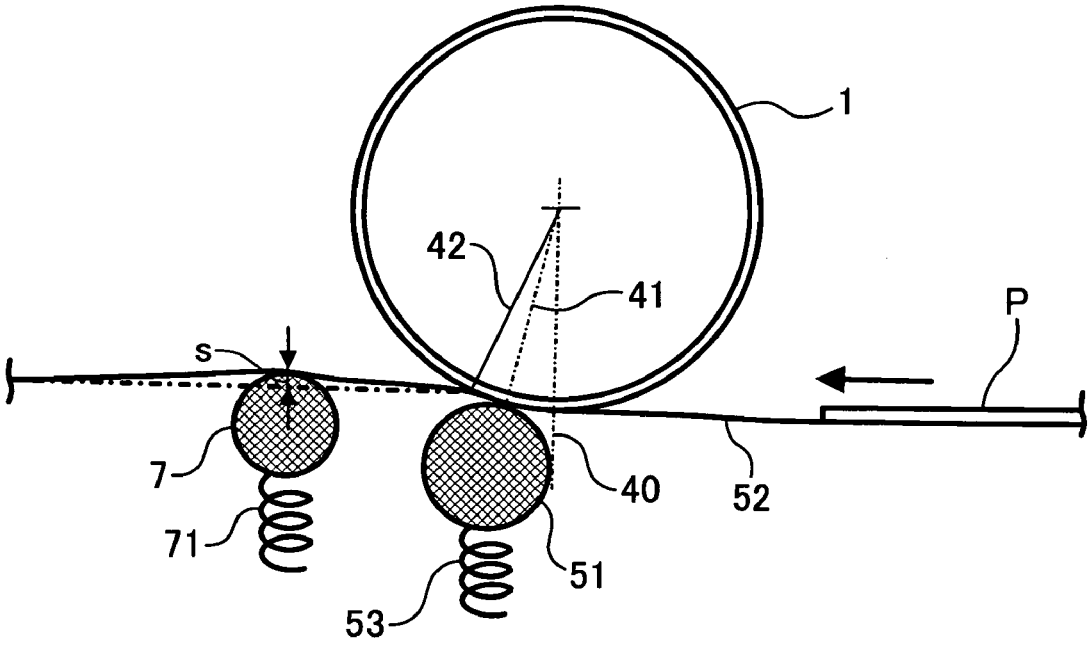
FIG. 2 is a view showing arrangements around an image transfer position unique to the first embodiment.

Reference will be made to FIG. 2 for describing the configuration of each image transfer position specifically. While the drums 1 and belt 52 are, in practice, arranged in the oblique direction, they are shown as being arranged in the horizontal direction for the sake of description. As shown, the image transfer roller 51 is shifted to the downstream side in the direction of movement of the belt 52 by 1 mm to 2 mm from a virtual vertical line 40 extending downward from the axis of the drum 1 to the belt 52.

More specifically, the center of the nip formed between the image transfer roller 51 and the belt 52 is located on a virtual line 41 shifted from the line 40, as illustrated. Therefore, the belt 52 wraps around the drum 1 over at least a range from the vertical line 40 to the line 41 at the upstream side in the direction of movement of the belt 52.

Stated another way, the belt 52 wraps around the drum 1 at the upstream side in the direction of movement of the belt 52 over a greater width than when the image transfer roller 51 is positioned on the vertical line 40. In a strict sense, the belt 52 wraps around the drum 1 over some range at the upstream side with respect to the vertical line 40 also, so that the sheet P can contact the drum 1 before an electric field for image transfer acts on the sheet P. This successfully reduces toner scattering and defective images ascribable to discharge. Further, because part of the belt 52 upstream of the vertical line 40 in the direction of movement of the belt 52 is not pressed, the leading edge of the sheet P is preventing from abutting against the drum 1.

The belt holding member 7, pressing the belt 52, causes the belt 52 to wrap around the drum 1 over a preselected range between the center of the nip and a downstream position indicated by a virtual line 42. Substantially the entire amount of wrapping of the belt 52 around the drum 1 is implemented by the belt holding member 7 while the image transfer roller 51 acting on the drum 1 is caused to exert minimum necessary pressure against the drum 1, as will be described hereinafter. It is to be noted that the term "minimum necessary pressure" refers to pressure of a degree that effects desirable image transfer without bringing about toner scattering or similar defect to be described later specifically.

Figure 5:
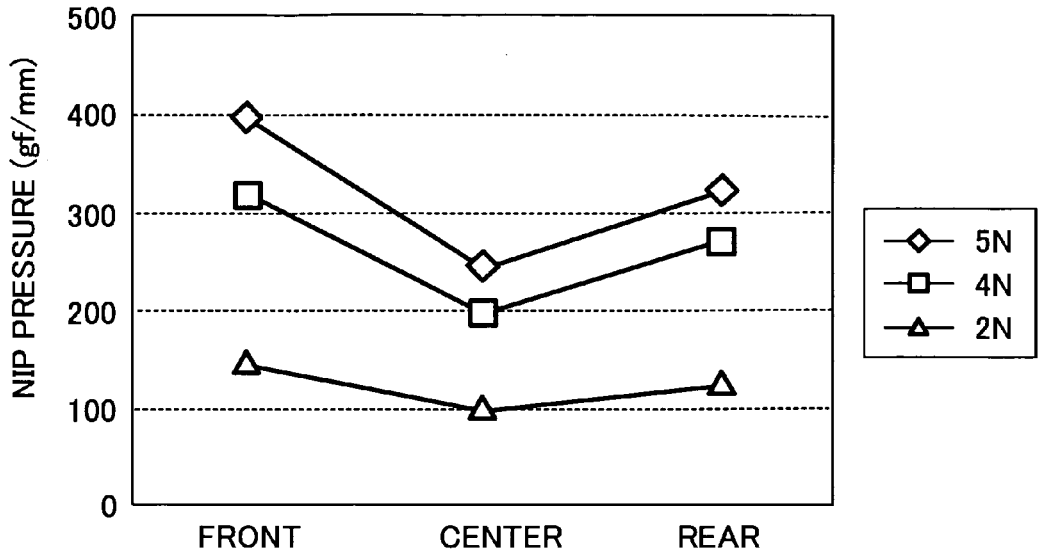
FIG. 5 is a graph showing a relation between pressure acting on the image transfer roller and the deviation of nip pressure in the axial direction.

FIG. 5 plots the results of experiments conducted to measure image transfer nip pressure at the front and rear ends and center in the axial direction of the image transfer roller 51 by varying the pressure of the image transfer roller 51. As shown, when the pressure of the image transfer roller 51 is high, the image transfer roller 51 is apt to deform in the axial direction with the result that the deviation of the nip pressure increases. Consequently, it is likely that an image is locally peeled off as if vermiculated or that an image transferred to the sheet P is locally transferred to the next or downstream drum 1 (reverse transfer hereinafter).

Figure 6:
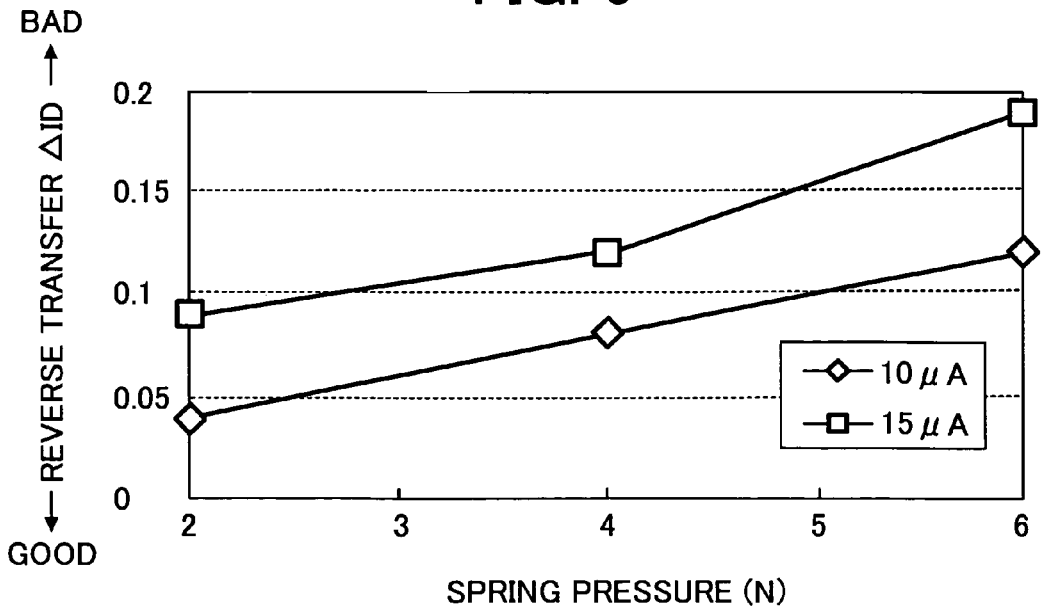
FIG. 6 is a graph showing a relation between pressure acting on the image transfer roller and reverse transfer.

FIG. 6 shows experimental results showing a relation between the reverse transfer and the pressure of the image transfer roller 51, i.e., nip pressure. I collected toner transferred from a solid pattern formed on the sheet P to the drum 1 located at the next image forming station with a sticker Printact Sticker (trade name) available from Kirihari and then measured reverse transfer ΔID by using X-Rite available from X-Rite. As FIG. 6 indicates, reverse transfer decreases with a decrease in nip pressure.

Figure 7:
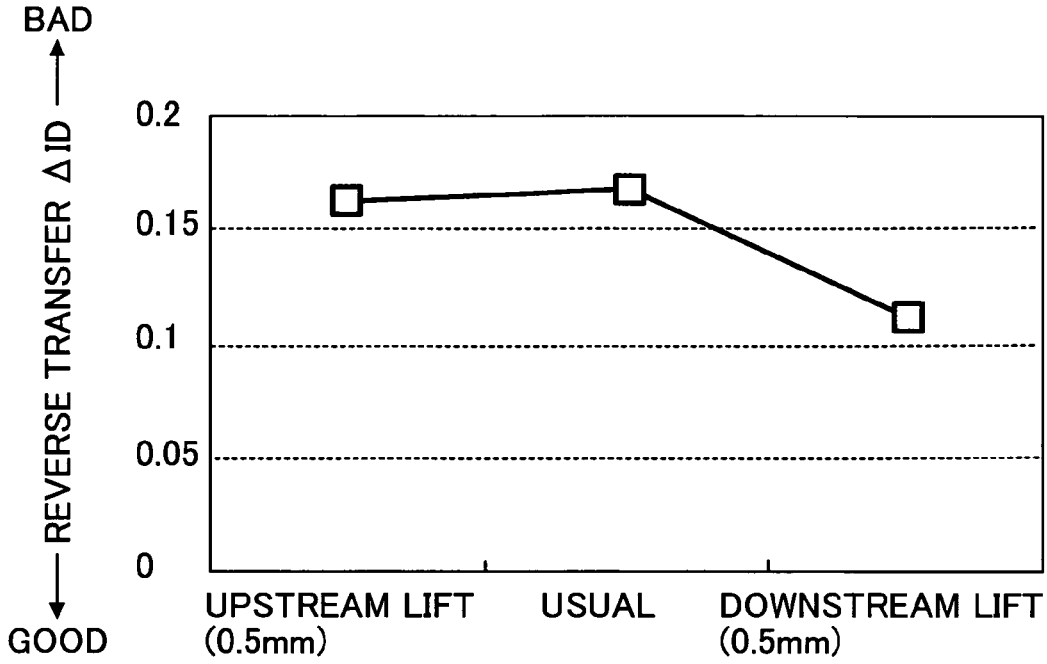
FIG. 7 is a graph showing a relation between the position of the belt holding member and reverse transfer.

FIG. 7 shows experimental results showing a relation between reverse transfer and the position of the belt holding member 7. In FIG. 7, the term "USUAL" indicates the position of the vertical line 40. As shown, reverse transfer is reduced when the belt holding member 7 presses the belt 52 at the downstream side.

Figure 8:
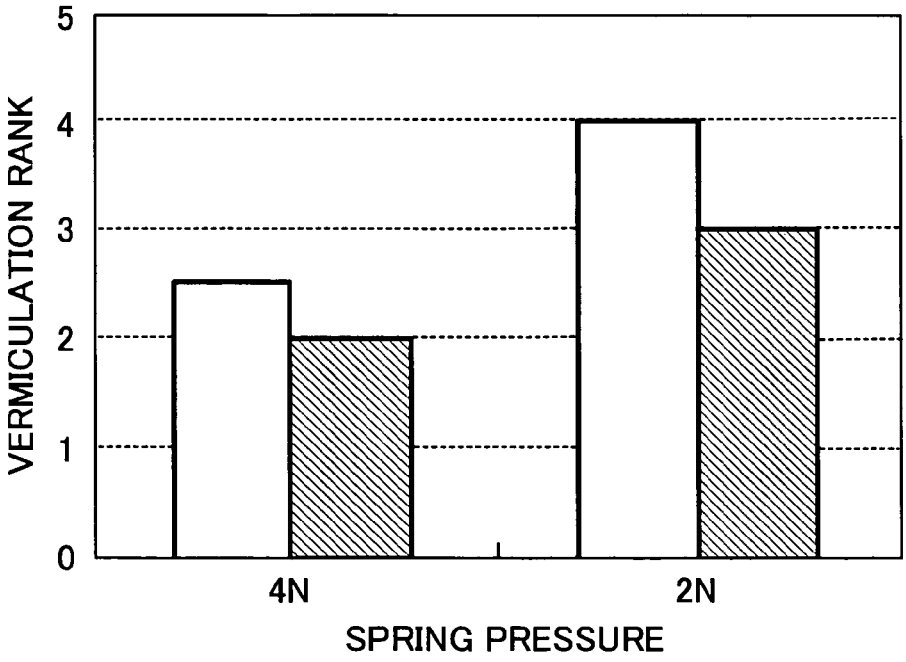
FIG. 8 is a graph showing a relation between pressure acting on the image transfer roller and vermiculation rank.

FIG. 8 shows experimental results showing a relation between the vermiculation rank and the nip pressure as determined with 135 $Kg/m^3$ paper sheets and post cards (hatching). As shown, the vermiculation rank rises when the nip pressure is lowered.

Considering the experimental results described above, the illustrative embodiment does not assign the function of pressing the belt 52 against the drum 1 to the image transfer roller 51, but assigns the function to the belt holding member 7.

In the nip configuration shown in FIG. 2, the image transfer roller 51 contacts the belt 52 within the width over which the belt 52 wraps around the drum 1, applying a bias for image transfer. In this condition, the sheet P contacts the drum 1 before it is subject to the above pressure, and is therefore free from toner scattering.

Further, the sheet P parts from the drum 1 after it has moved away from the bias applying range, so that reverse transfer ascribable to separation discharge does not occur at the position downstream of the image transfer nip. Moreover, because the pressure of the image transfer roller 51 is made as low as possible, the vermiculation of an image ascribable to the pressure to act at the image transfer position is obviated.

When the image transfer roller 51 is used as a bias applying member, the roller 51 should preferably have low hardness because when the sheet P is relatively thick, vermiculation or similar defect does not occur because of an escape mechanism. However, if the image transfer roller 51 is excessively soft, then the nip width between the roller 51 and the belt 52 becomes so great, it is difficult to confine the nip width in the range over which the belt 52 wraps around the drum 1.

The image transfer roller 51 is pressed toward the drum 1 at both sides of the belt 52 by two springs 53 (only one is visible). In the illustrative embodiment, the bias of each spring 53 is weaker than the tension acting on the belt 52 and is so selected as not to press the belt 52 upward although it can bear the weight of the image transfer roller 51. The image transfer roller 51 is therefore biased in such a condition that it is not limited in position toward the drum 1.

In the illustrative embodiment, the belt holding member 7 is spaced from the image transfer roller 51 by about 20 mm to the downstream side. The belt holding member 7 serves to wrap the belt 52 around the drum 1 at a position downstream of the nip formed by the image transfer roller 51. The belt holding member 7 is positioned such that the width over which the belt 52 wraps around the drum 1 is greater when the belt holding member 7 is mounted than when it is dismounted.

On the other hand, if the belt holding member 7 raises the belt 52 to an excessive degree, then it is apt to obstruct the smooth conveyance of the sheet P. In light of this, the position of the belt holding member 7 should preferably be controlled by a spring or similar resilient member 71. The resilient member 71 is configured to allow the level or height of the belt holding member 7 to vary, in accordance with the hardness of the sheet P, within the range of about 0 mm to 2 mm above the level of the belt 52 that holds in the absence of the belt holding member 7.

Figure 9:
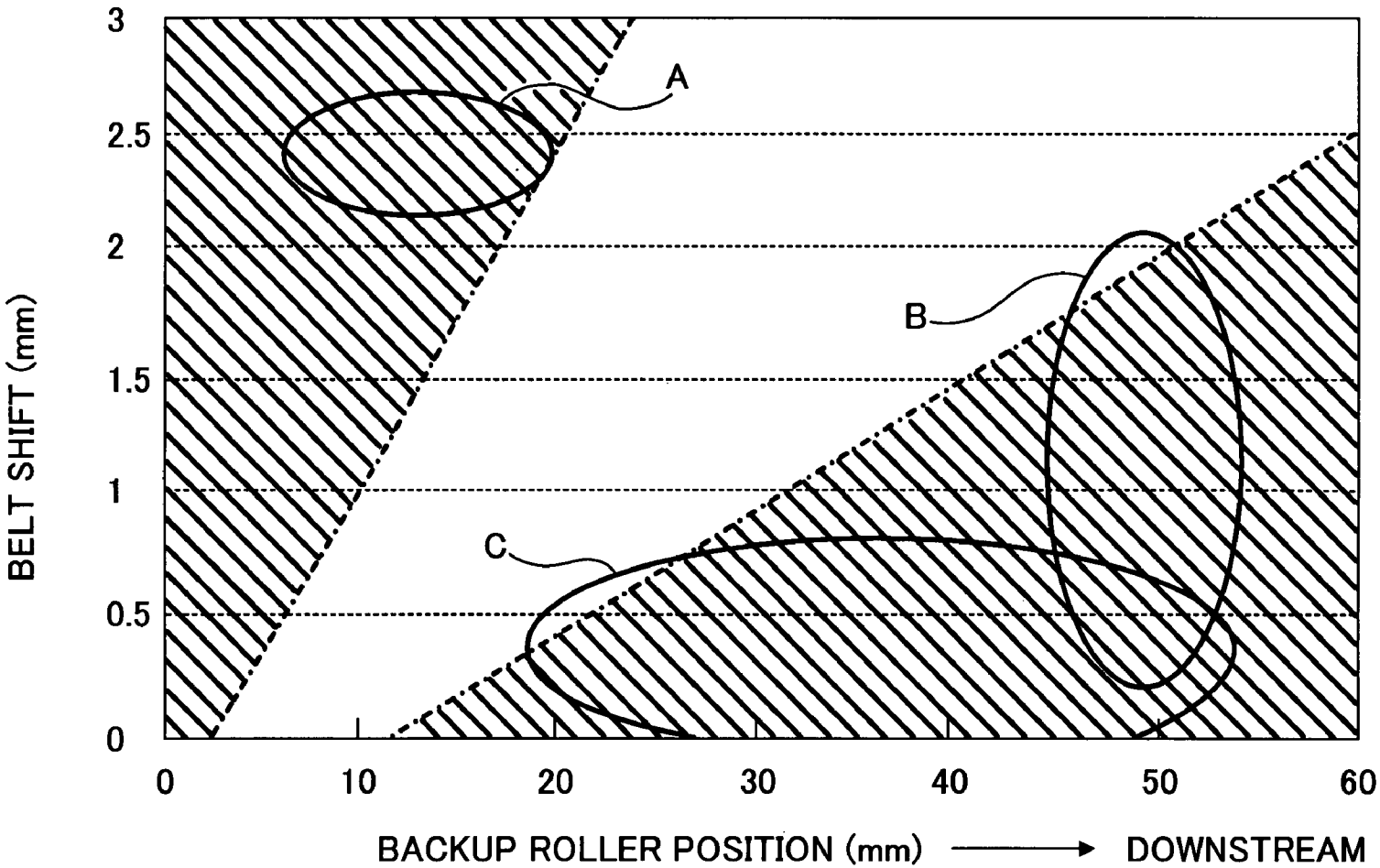
FIG. 9 is a graph showing a relation between the position of the belt holding member and the lift of an image transfer belt.

FIG. 9 shows experimental results showing a relation between the lift of the belt 52 toward the drum 1 and the position of the belt holding member or backup roller 7. The lift of the belt 52 is labeled s in FIG. 2. The position of the belt holding position 7 is measured from the position of the image transfer roller 51. In FIG. 9, undesirable ranges are indicated by hatching. Particularly in a range A, a process unit rubbed postcards while, in a range B, a monochromatic image transfer ratio was low. Further, in a range C, the transfer of an image over an image present on the sheet was defective. The range other than the ranges indicated by hatching is desirable.

Particularly, a condition wherein the position of the belt holding member 7 was 20 mm and the shift or lift s was between 0.4 to 0.6 was excellent.

When the shift of the belt 52 was great, the accurate register of images was obstructed. It is necessary to sequentially increase the shift s from the upstream belt holding member 7 toward the downstream belt holding member 7.

Figure 3:
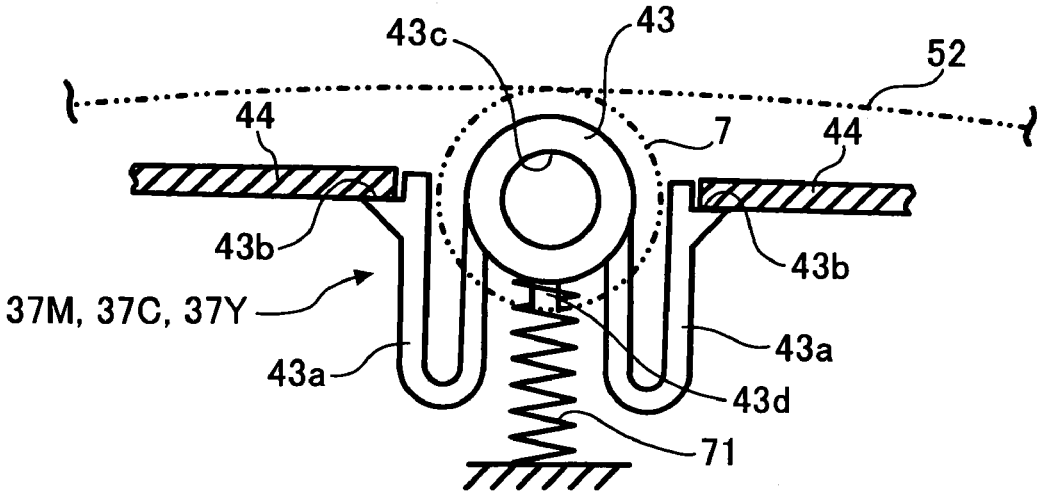
FIG. 3 shows pressing means assigned to a belt holding member included in the first embodiment.

As shown in FIG. 3, the pressing means 37, pressing the belt holding member 7, includes a bearing member 43 in addition to the spring 71. Generally U-shaped arms 43*a* extend out from opposite sides of the bearing member 43. Locking surfaces 43*b* are formed at the free ends of the arms 43*a* and abutted against a bracket 44, which is a stop included in the image transferring unit 34 or the printer body. Labeled 43*d* is a projection serving as a spring seat. The belt holding member 7 has its shaft received in a support hole 43*c* formed in the bearing member 43 and is rotatably supported thereby.

In the configuration stated above, the belt holding member 7 is not movable toward the drum 1 in the direction of thickness of the belt 52, but movable in the opposite direction under the action of the spring 71. More specifically, the bias of the spring 71 is selected such that the belt holding member 7 raises the belt 52 by overcoming the tension of the belt 52, but moves, when the sheet P has thickness greater than preselected one, away from the drum 1, i.e., in the opposite direction due to the hardness of the sheet P.

It was experimentally found that when the belt holding member 7 was formed of a conductive material, toner scattering occurred. This is presumably because an image transfer current applied by the belt 52 flows to the belt holding member 7, which is positioned at the downstream side, causing toner to be scattered. To solve this problem, in the illustrative embodiment, the belt holding member 7 is made up of a metallic roller and a thermally shrinkable tube or medium-resistance layer fitted on the metallic roller.

For the thermally shrinkable tube, use was made of Hishi Tube (trade name) available from MITSUBISHI PLASTICS INDUSTRIES LTD. Hishi Tube has volumetric resistivity of $5\times10^{12}$ Ω·cm. The belt holding member 7 with this configuration did not cause toner to be scattered at all. The resistance or volumetric resistivity of the medium-resistance layer should preferably be between $1\times10^{8}$ Ω·cm and $1\times10^{13}$ Ω·cm.

The belt holding member 7 may be implemented as, e.g., a blade instead of a roller so long as it is not movable toward the drum 1, if desired. Further, the belt holding member 7 may be pressed by a biasing member in such a manner as to be movable toward the drum 1.

Figure 10:
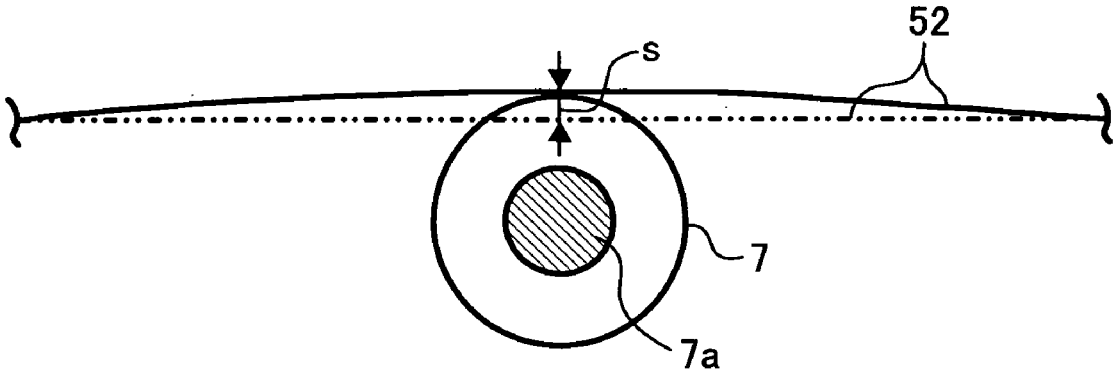
FIG. 10 shows a belt holding member representative of a second embodiment of the present invention.

FIG. 10 shows a second embodiment of the present invention. In FIG. 10, structural elements identical with the structural elements of the first embodiment are designated by identical reference numerals and will not be described specifically in order to avoid redundancy. This is also true with other embodiments to be described later. As shown, the second embodiment is characterized in that the belt holding member 7 is fixed in position in both directions in the direction of thickness of the belt 52. For users using only sheets P having thickness smaller than preselected one, it is not necessary for the belt holding member 7 to be displaceable.

The belt holding member 7 is made up of a metallic roller and a thermally shrinkable tube as in the first embodiment. The belt holding member has a rotary shaft 7*a* affixed to opposite side walls of the image transferring unit 34 or those of the printer body.

Figure 11:
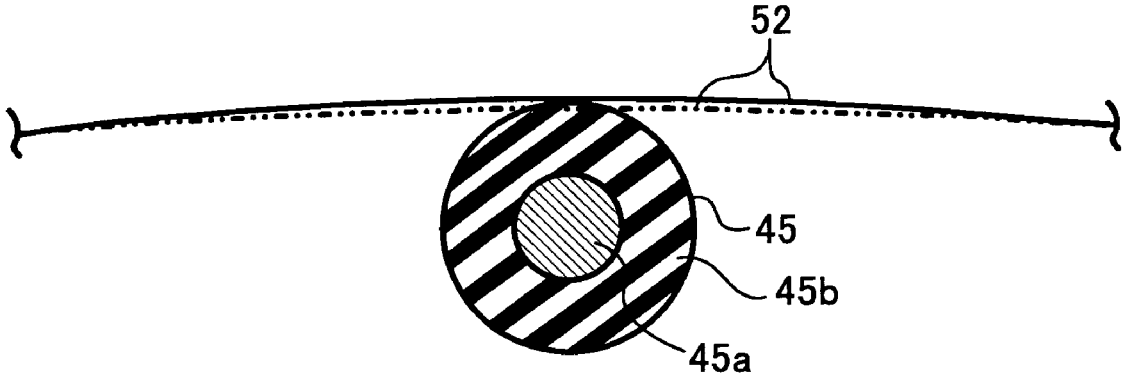
FIG. 11 shows a belt holding member representative of a third embodiment of the present invention.

FIG. 11 shows a third embodiment of the present invention. In the illustrative embodiment, the belt holding member is provided with an elastic layer and fixed in position in both directions in the direction of thickness of the belt 52. The elasticity of the elastic layer is selected such that the side of the roller adjacent to the drum 1 is displaceable away from the drum 1.

As shown in FIG. 11, a belt holding member 45 is made up of a metallic rotary shaft 45*a* and an elastic layer 45*b* covering the shaft 45*a* and formed of rubber. While the shaft 45*a* is fixed in position, the elastic layer 45*b* is displaceable when the sheet P has thickness greater than preselected one in accordance with the hardness of the sheet P.

More specifically, the side of the elastic layer 45 adjacent to the drum 1 is usually fixed in position by overcoming the tension of the belt 52 although it deforms. When the sheet P has thickness greater than preselected one, the elastic layer 45*b* is further deformable to a position indicated by a dots-and-dash line in FIG. 11. The resistance of the elastic layer 45*b* is so selected as not to bring about toner scattering in relation to the bias for image transfer.

Figure 12:
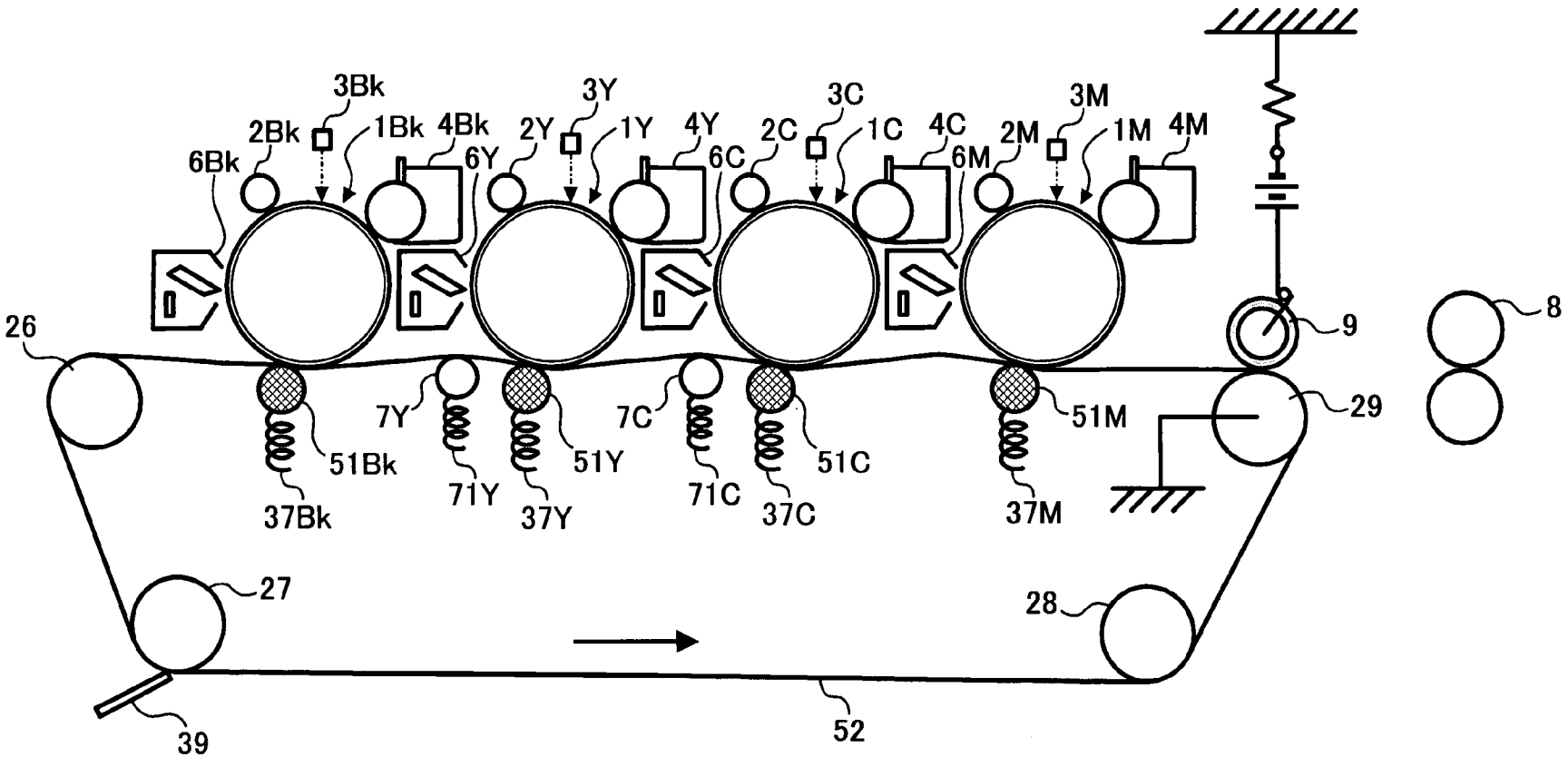
FIG. 12 is a fragmentary front view showing a fourth embodiment of the present invention.

FIG. 12 shows a fourth embodiment of the present invention. The belt holding member 7 should preferably be associated with all of the four bias applying members 51M through 51Bk if allowable in relation to layout space available, so that the misregister of colors, toner scattering and reverse transfer can be effectively obviate. If this configuration is not practicable due to limited layout space, then only two belt holding members 7 may be used, as shown in FIG. 12. More specifically, two belt holding members 7 respectively adjoin two center image transfer positions assigned to C and Y. This is because image transfer of the second and third colors needs consideration more than image transfer of the first color and because the most downstream drum 1 corresponds to Bk which is used alone. Even the configuration shown in FIG. 2 is also capable of obviating the misregister of colors, toner scattering, reverse transfer, and vermiculation.

Figure 13:
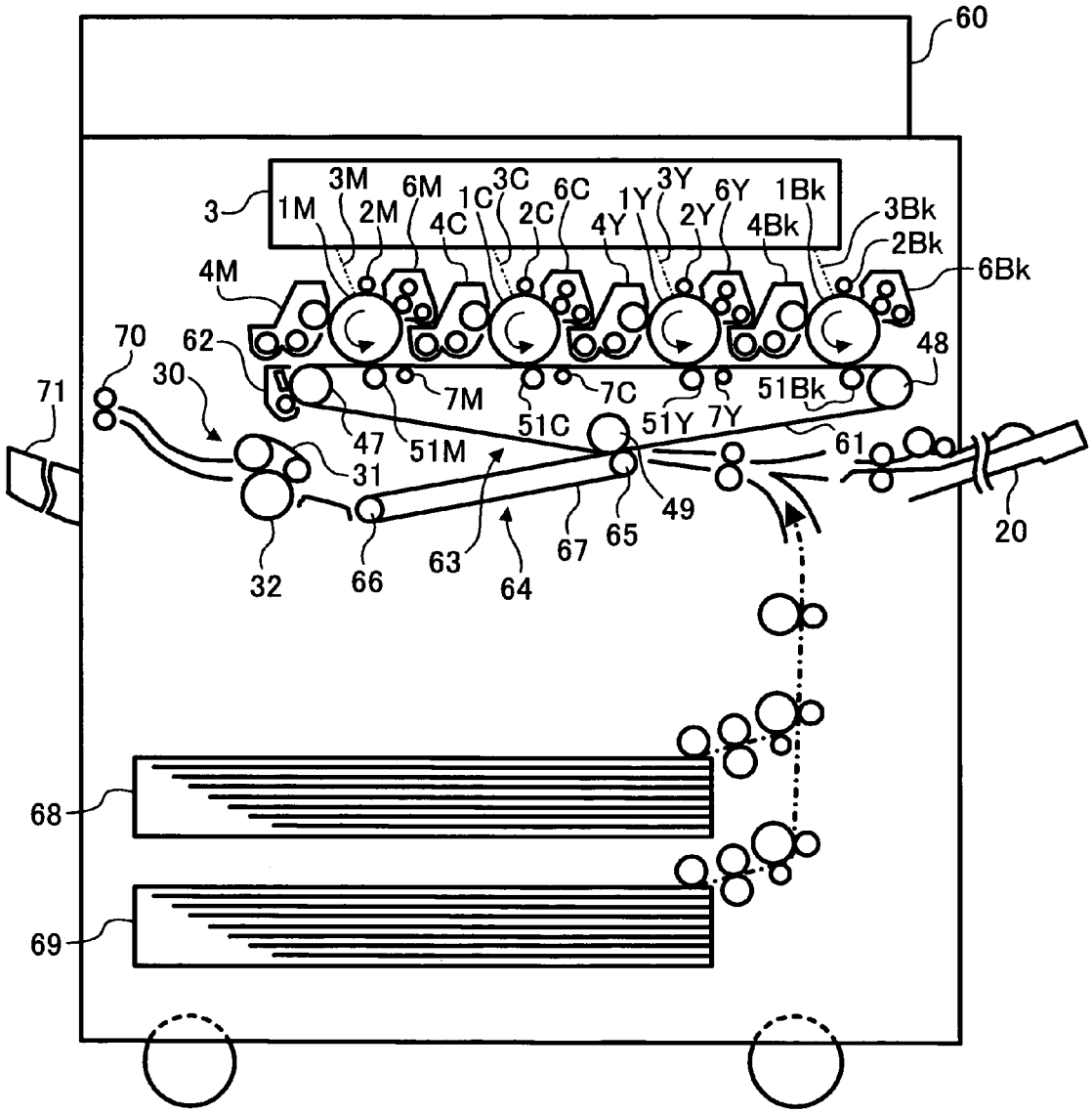
FIG. 13 shows a fifth embodiment of the present invention.

Reference will be made to FIG. 13 for describing a fifth embodiment of the present invention. This embodiment is implemented as a tandem, indirect image transfer type of color copier. As shown, the color copier includes a scanner 60. Latent images are formed on the drums 1 in accordance with image data read by the scanner 60. An intermediate image transfer belt 61 is positioned below the drums 1 and passed over support rollers or support members 47, 48 and 49. Cleaning means 62 cleans the surface of the belt 61 after image transfer. The belt 61, support rollers 47 through 49 and cleaning means 62 constitute an image transferring unit 63.

Image transfer rollers 51M, 51C, 51Y and 51Bk respectively face the drums 1M, 1C, 1Y and 1Bk with the intermediary of the belt 61. The belt support members 7M, 7C and 7Y are positioned downstream of the image transfer rollers 51M, 51C and 51Y, respectively. The image transfer rollers 51M through 51Bk and belt holding members 7M through 7Y are positioned and operated in the same manner as in the previous embodiments.

Toner images formed on the drums 1M through 1Bk are sequentially transferred to the belt 61 one above the other, completing a full-color toner image (primary image transfer). Subsequently, the full-color toner image is transferred from the belt 61 to the sheet P at a position where the belt 61 is passed over the support roller 49 (secondary image transfer). The support roller 49 faces a secondary image transferring device 64 with the intermediary of the belt 61.

The secondary image transferring device 64 includes a belt conveyor 67 is passed over a charge/drive roller 65 and a driven roller 66 and movable in the same direction as the belt 61. The charge/drive roller 65 charges the belt 67 to thereby transfer the full-color image or a monochromatic image, as the case may be, from the belt 67 to the sheet P.

The sheet P fed from a sheet cassette 68 or 69 or the manual sheet feed tray 20 is conveyed by the registration roller pair 8 to the secondary image transfer position at preselected timing. Subsequently, the sheet P, carrying the toner image thereon, is conveyed to the fixing unit 30 and then driven out to a copy tray 71 by an outlet roller pair 70.

With the configuration described above, it is also possible to obviate the various image defects stated earlier.

While the illustrative embodiments have concentrated on a tandem, four-color image forming system, the present invention is similarly applicable to an image forming system so long as it deals with two or more colors.

In summary, it will be seen that the present invention provides an image forming apparatus having various unprecedented advantages, as enumerated below.

(1) The misregister of colors, which is a serious problem with a tandem, four-color image forming apparatus, is effectively reduced. Further, abnormal distance at the upstream side of an image transfer nip and separation discharge at the downstream of the same are reduced. The apparatus can therefore produce images of extremely high quality.

(2) Frictional resistance between a bias applying member and an image transfer body is reduced to extend the life of the image transfer body. In addition, the drive resistance of the image transfer body and therefore power consumption of a drive source is reduced.

(3) Toner scattering is reduced at the time of image transfer.

(4) An image transfer body holding member can be simply configure and arranged, making the apparatus compact.

(5) Accurate register is achievable even when a relatively thick recording medium is used.

(6) A bias current for image transfer is prevented from flowing to the image transfer body holding member, so that toner scattering is obviated.

Various modifications will become possible for those skilled in the art after receiving the teachings of the present disclosure without departing from the scope thereof.

What is claimed is:

1. An image forming apparatus for forming a toner image on a sheet-like recording medium, said image forming apparatus comprising:

a plurality of image carriers arranged side by side;

charging means, exposing means and developing means arranged around each of said plurality of image carriers for respectively charging an associated one of said plurality of image carriers, forming a latent image on said associated image carrier and developing said latent image with toner to thereby produce a corresponding toner image; and image transferring means for sequentially transferring toner images formed on said plurality of image carriers to the recording medium one above the other;

wherein said image transferring means comprises an image transfer belt and a plurality of bias applying members for applying image transfer biases to image transfer nips formed between said plurality of bias applying members and said plurality of image carriers, which face each other with the intermediary of said image transfer belt, said plurality of bias applying members each has an axis positioned downstream, in a direction of movement of said image transfer belt, of a virtual vertical line extending from an axis of an associated one of said plurality of image carriers downward, and at least two of said plurality of bias applying members are provided with respective belt holding members positioned downstream of said two bias applying members in the direction of movement of said image transfer belt, each said belt holding member being supported by a resilient member.

2. The apparatus as claimed in claim 1, further comprising a plurality of pressing means for respectively pressing said plurality of bias applying members against said plurality of image carriers, wherein a position of each belt holding member and a pressure of each bias applying member are selected such that a width over which said image transfer belt is caused to wrap around each image carrier by said bias applying member associated with said image carrier is greater when said belt holding member is mounted than when said belt holding member is dismounted.

3. The apparatus as claimed in claim 1, further comprising a plurality of pressing means for respectively pressing said plurality of bias applying members against said plurality of image carriers, wherein a distance from an axis of each image carrier to each bias applying member is greater when said belt holding member is dismounted than when said belt holding member is mounted.

4. The apparatus as claimed in claim 1, wherein each bias applying member contacts said image transfer belt within a width over which said image transfer belt wraps around said image carrier.

5. The apparatus as claimed in claim 1, wherein each bias applying member comprises an image transfer roller.

6. A method of forming a toner image on a sheet-like recording medium, including:

forming an image on a first image carrier;

passing a belt-like image transfer body over a plurality of support members;

applying an image transfer bias to a bias applying member that faces said image carrier with the intermediary of said image transfer body;

transferring an image formed on another image carrier located downstream of said first image carrier in a direction of movement of said image transfer body;

shifting an axis of said bias applying member from a virtual vertical line extending from an axis of said image carrier downward to a downstream side in a direction of movement of said image transfer body;

positioning an image transfer body holding member downstream of said bias applying member for pressing said image transfer body toward said image carrier to thereby cause said image transfer body to wrap around said image carrier over a preselected range downstream of a center of an image transfer nip; and biasing said image transfer body holding member toward said image carrier by an elastic member.

7. The method as claimed in claim 6, further including:

wrapping said image transfer body around said image carrier at a position upstream of the image transfer nip in the direction of movement of said image transfer body at a width greater than when said bias applying member is positioned on the vertical line.

8. The method as claimed in claim 6, further including:

pressing said bias applying member, wherein a substantially entire amount of wrapping of said image transfer body around said image carrier is established by a pressure of said image transfer body holding member to thereby allow said bias applying member to exert a minimum necessary pressure on said image carrier.

9. The method as claimed in claim 6, further including:

conveying a sheet-like recording medium via said image transfer body to thereby allow the images to be transferred to said recording medium, and a bias of said elastic member is selected such that said image transfer body holding member moves away from said image carrier in accordance with a thickness of said recording medium.

10. The method as claimed in claim 6, further including:

configuring said image transfer body holding member to be unmovable toward said image carrier in a direction of thickness of said image transfer body, but movable in an opposite direction.

11. The method as claimed in claim 10, further including:

biasing said image transfer body holding member via a roller rotatably supported by a bearing, which is biased by said elastic member and fixed in position at a preselected position by a stop.

12. The method as claimed in claim 10, further including:

conveying a sheet-like recording medium via said image transfer body to thereby allow the images to be transferred to said recording medium; and biasing said image transfer body holding member such that said image transfer body holding member moves away from said image carrier in accordance with a thickness of said recording medium.

13. The method as claimed in claim 6, wherein said image transfer body holding member is formed of a material that substantially does not electrically operate in relation to an image transfer body applied to said bias applying member.

14. The method as claimed in claim 13, wherein said image transfer body holding member is provided with a medium-resistance layer on at least a surface thereof.

15. An image transferring unit comprising a belt-like image transfer body passed over a plurality of support members and having a surface movable via a plurality of image carriers, which are mounted on a body of an image forming apparatus side by side, and a plurality of bias applying members respectively facing said plurality of image carriers with the intermediary of said image transfer body and applied with biases for transferring images formed on said plurality of image carriers, an axis of each bias applying member is shifted from a virtual vertical line extending from an axis of an associated image carrier downward to a downstream side in a direction of movement of said image transfer body, and an image transfer body holding member is positioned downstream of said bias applying member for pressing said image transfer body toward said image carrier to thereby cause said image transfer body to wrap around said image carrier over a preselected range downstream of a center of an image transfer nip, wherein each image transfer body holding member is supported by a resilient member.

16. The unit as claimed in claim 15, wherein a width over which said image transfer body wraps around said image carrier at a position upstream of the image transfer nip in the direction of movement of said image transfer body is greater than when said bias applying member is positioned on the vertical line.

17. The unit as claimed in claim 15, further comprising pressing means for pressing said bias applying member, wherein a substantially entire amount of wrapping of said image transfer body around said image carrier is established by a pressure of said image transfer body holding member to thereby cause said bias applying members to exert a minimum necessary pressure on said image carrier.

* * * * *